US009204690B1

(12) United States Patent
Alt et al.

(10) Patent No.: US 9,204,690 B1
(45) Date of Patent: Dec. 8, 2015

(54) DEVICE FOR AUTOMATICALLY TIGHTENING AND LOOSENING SHOE LACES

(71) Applicants: Jepthah Alt, Washington, UT (US); Jesse Kimball, Washington, UT (US)

(72) Inventors: Jepthah Alt, Washington, UT (US); Jesse Kimball, Washington, UT (US)

( * ) Notice: Subject to any disclaimer, the term of this patent is extended or adjusted under 35 U.S.C. 154(b) by 0 days.

(21) Appl. No.: 14/107,925

(22) Filed: Dec. 16, 2013

Related U.S. Application Data

(60) Provisional application No. 61/737,982, filed on Dec. 17, 2012.

(51) Int. Cl.
*A43C 11/20* (2006.01)

(52) U.S. Cl.
CPC ..... *A43C 11/20* (2013.01); *Y10T 24/3713* (2015.01); *Y10T 24/3724* (2015.01)

(58) Field of Classification Search
CPC ..... A43C 11/20; A43C 7/00; A43C 1/00; Y10T 24/3724; Y10T 24/3713; Y10T 24/3703; Y10T 24/3716
USPC ..... 24/712, 712.1, 712.5, 712.9; 36/50.5; 242/390.8
See application file for complete search history.

(56) References Cited

U.S. PATENT DOCUMENTS

| | | | | |
|---|---|---|---|---|
| 3,430,303 | A * | 3/1969 | Wakefield et al. | 24/712.3 |
| 4,724,626 | A * | 2/1988 | Baggio | 36/117.8 |
| 4,741,115 | A * | 5/1988 | Pozzobon | 36/117.7 |
| 4,787,124 | A * | 11/1988 | Pozzobon et al. | 24/68 SK |
| 6,289,558 | B1 * | 9/2001 | Hammerslag | 24/68 SK |
| 7,082,701 | B2 * | 8/2006 | Dalgaard et al. | 36/50.1 |
| 7,549,201 | B2 * | 6/2009 | Kraft et al. | 24/713 |
| 7,591,050 | B2 * | 9/2009 | Hammerslag | 24/68 SK |
| 7,752,774 | B2 * | 7/2010 | Ussher | 36/50.1 |
| 8,046,937 | B2 | 11/2011 | Beers et al. | |
| 8,522,456 | B2 | 9/2013 | Beers et al. | |
| 8,769,844 | B2 | 7/2014 | Beers et al. | |

* cited by examiner

*Primary Examiner* — Abigail Morrell
(74) *Attorney, Agent, or Firm* — Risso & Associates

(57) ABSTRACT

Described is a device for automatically tying and untying shoe laces. The device includes a gear box for positioning with the tongue of a shoe, the gear box having pulleys around which laces can be wound. A motor is included in the gear box for selectively turning the pulleys to wind and unwind the laces. Controls accessible via the tongue of a shoe are provided for activating the motor. The laces are included for winding through lace holes of the shoe and around the pulleys. To prevent snagging and provide for smooth operation of the laces, the laces are formed of a plastic cable with a lacing sleeve wrapped around the plastic cable.

2 Claims, 5 Drawing Sheets

Gear Box Inner

Automatic Shoe Lacing System
(e.g., built into the tongue)

Gear Box Overview

Gear Box Inner

Pulley Cable System

DEVICE FOR AUTOMATICALLY TIGHTENING AND LOOSENING SHOE LACES

CROSS-REFERENCE TO RELATED APPLICATIONS

This is a non-provisional application of U.S. Provisional Application No. 61/737,982, filed on Dec. 17, 2013, and entitled, "Power Laces."

BACKGROUND OF THE INVENTION (1) Field of Invention

The present invention relates to automated shoe laces and, more particularly, to a device for automatically tying and untying shoe laces.

(2) Description of Related Art

Learning how to tie shoe laces has been a rite of passage for small children who often struggle to manipulate the laces. Similarly, disabled and elderly individuals who lose digit dexterity often have problems manipulating the thin laces.

Thus, a continuing need exists for a device for automatically tying and untying shoe laces.

SUMMARY OF INVENTION

The present invention relates to a device for automatically tying and untying shoe laces. The device includes a gear box for positioning with the tongue of a shoe, the gear box having pulleys around which laces can be wound. A motor is included in the gear box for selectively turning the pulleys to wind and unwind the laces. Controls accessible via the tongue of a shoe are provided for activating the motor. The laces are included for winding through lace holes of the shoe and around the pulleys. To prevent snagging and provide for smooth operation of the laces, the laces are formed of a plastic cable with a lacing sleeve wrapped around the plastic cable.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to automated shoe laces and, more particularly, to a device for automatically tying and untying shoe laces. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
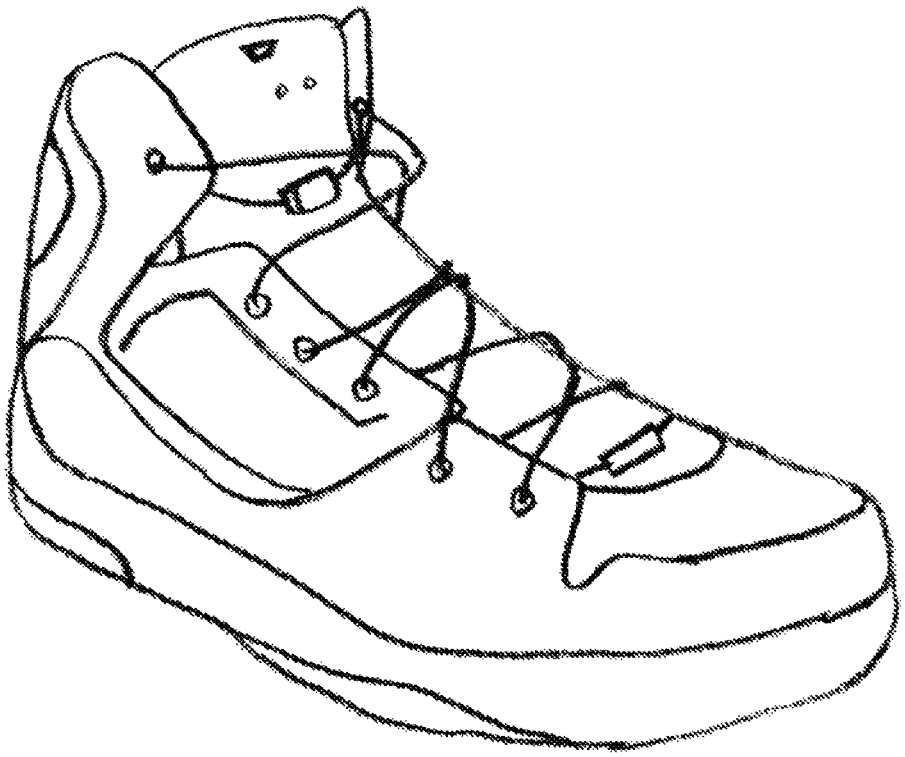
FIG. 1 is a drawing of a shoe with the automatic shoe lacing system incorporated therein, according to the principles of the present invention.
Figure 2:
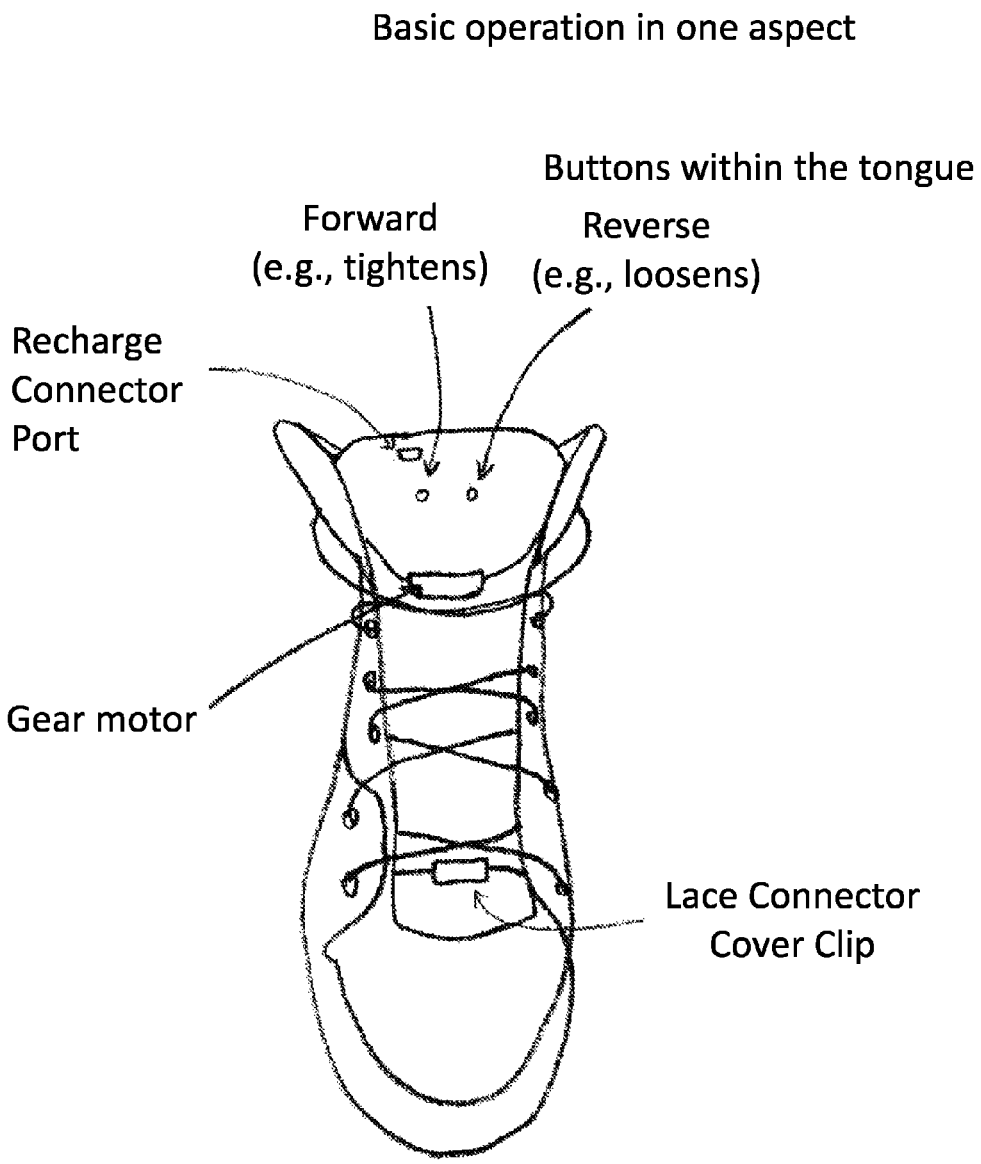
FIG. 2 is a drawing a shoe with the automatic shoe lacing system incorporated therein, depicting various components and operations of the system, according to the principles of the present invention.
Figure 3:
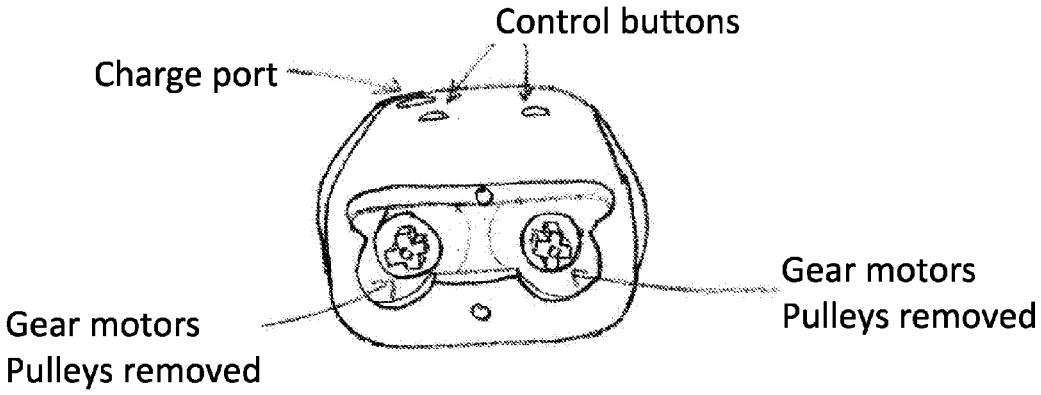
FIG. 3 is a drawing of a gear box system that is used to provide the tying and untying functions of the automatic shoe lacing system, according to the principles of the present invention.
Figure 3:
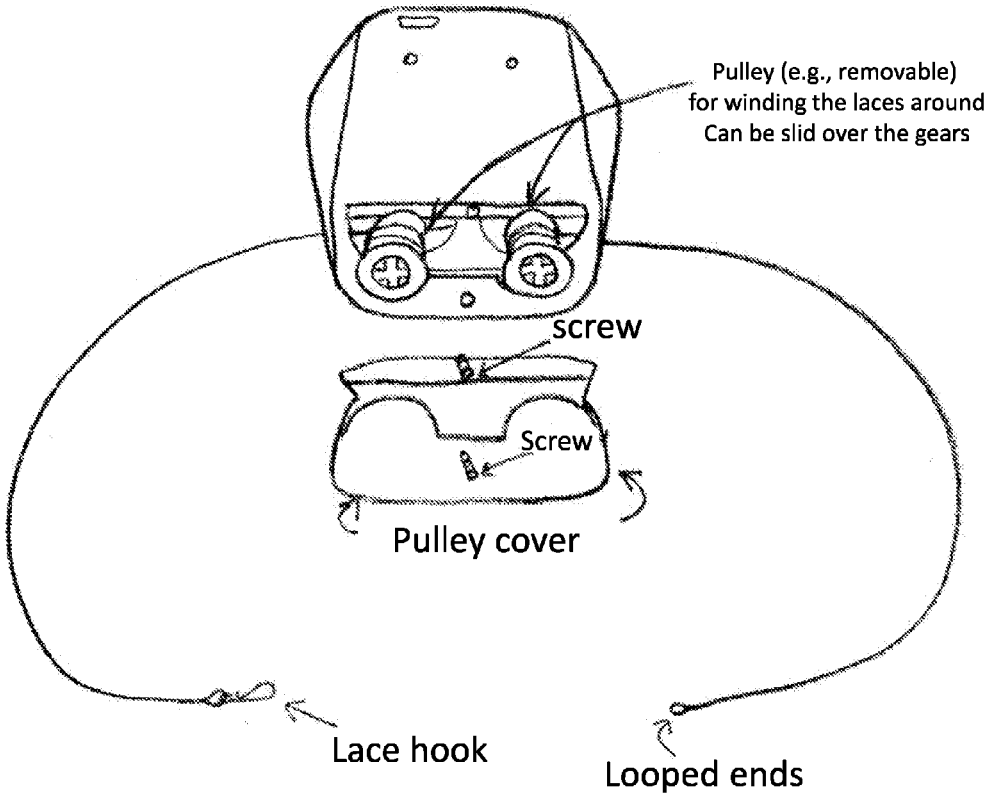
Figure 4:
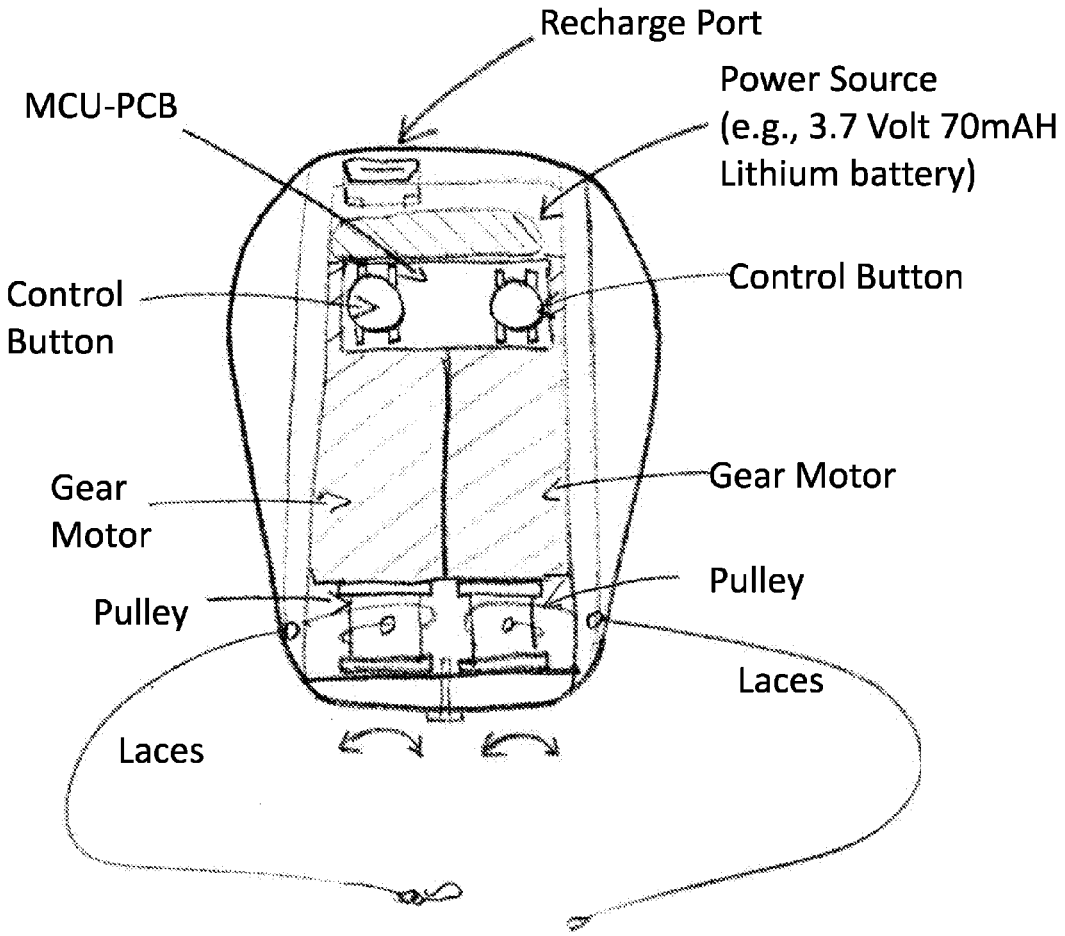
FIG. 4 is an interior view illustration of the gear box, according to the principles of the present invention.
Figure 5:
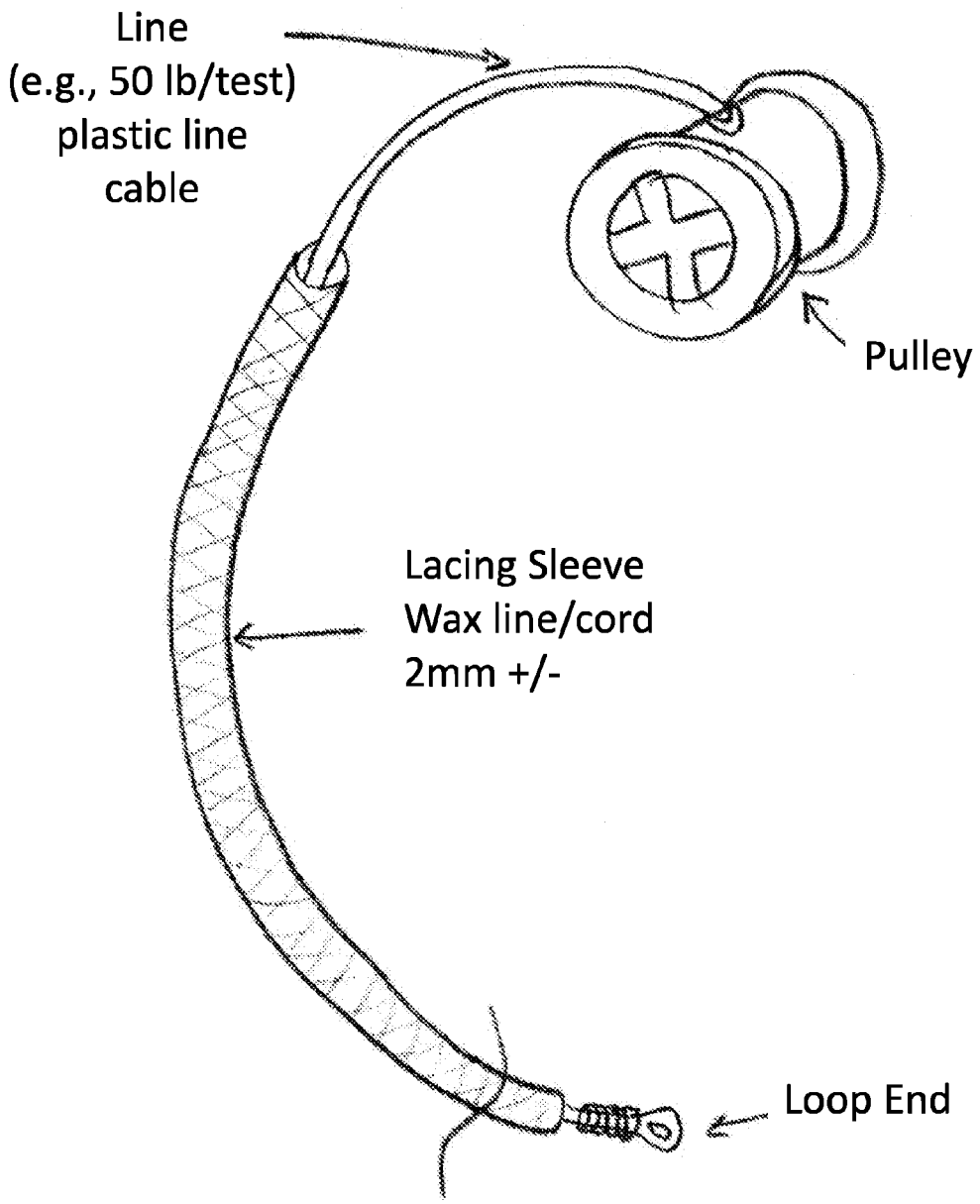
FIG. 5 is an illustration of example laces that can be used with the automatic shoe lacing system, according to the principles of the present invention.

The present invention relates to automated shoe laces and, more particularly, to a device for automatically tying and untying shoe laces. As shown throughout FIGS. 1 through 5, the device uses a winding mechanism (with a gear box) that can be positioned at any suitable location within the shoe. Desirably, the gear box is a miniaturized gear box that is positioned within the tongue of the shoe and that allows for the controls of the gear box to manipulated by pressing at the appropriate location on the tongue of the shoe. The laces are wound through the lace holes of the shoe and back to the pulley in the gear box. Thus, by activating the pulley in the gear box, the laces are tightened or loosened, depending on the configuration and control selected.

Although the controls are depicted as within the tongue of the shoe, the invention is not limited thereto as they can be positioned at any suitable location on the shoe or, in another aspect, separate from the shoe such that they wirelessly communicate with the gear box.

It should also be understood that the winding mechanism can be permanently incorporated directly into a shoe or, alternatively, formed as a removable system that can be separately formed and removably attached with (via a clip or some other suitable attachment mechanism) a shoe.

It should be understand that although the laces are depicted as having plastic cable with a lacing sleeve, the invention is not intended to be limited thereto as any suitable lacing system can be used. As another example, a metal or nylon cable can be employed, without or without the sleeve. However, desirably, the laces are formed of a plastic cable with a lacing sleeve wrapped there around.

To power the device, a power source such as a battery or any other power source can be included in the gear box. The battery can be replaceable or rechargeable via the charge port, using a micro USB or any other suitable charge port connector.

It should also be noted that any suitable gears or other components can be incorporated into the device. Thus, the example illustrated is but on non-limiting example of a suitable device for automatically tying and untying shoe laces according to the principles of the present invention.

What is claimed is:

1. An automatic shoe lace tightening and loosening device, comprising:

a gear box for positioning with a tongue of a shoe, the gear box having a pair of pulleys;

shoe laces for winding through lace holes of the shoe and around the pair of pulleys;

a pair of motors for selectively turning the pulleys to wind and unwind the shoe laces, wherein each motor is fixed in engaging contact with the pulleys; and controls accessible via the tongue of the shoe for activating the pair of motors, such that upon activation, each motor rotates in an opposite direction of the other.

2. The device as set forth in claim 1, wherein the shoe laces are formed of a plastic cable with a lacing sleeve wrapped there around.

* * * * *